US007200979B2

(12) United States Patent
Hannen

(10) Patent No.: US 7,200,979 B2
(45) **Date of Patent: *Apr. 10, 2007**

(54) SHRINK- OR STRETCH-WRAPPING SYSTEM FOR OBJECT STACK

(75) Inventor: Reiner Hannen, Kalkar-Wissel (DE)

(73) Assignee: MSK- Verpackungs-Systeme Gesellschaft mit beschrankter Haftung, Kleve (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/130,560

(22) Filed: May 17, 2005

(65) Prior Publication Data

US 2005/0210841 A1 Sep. 29, 2005

Related U.S. Application Data

(63) Continuation of application No. 10/468,424, filed as application No. PCT/EP02/01813 on Feb. 21, 2002, now Pat. No. 6,945,016.

(30) Foreign Application Priority Data

Feb. 22, 2001 (DE) ..... 201 03 153 U

(51) Int. Cl.
*B65B 9/14* (2006.01)

(52) U.S. Cl. ..... 53/567; 53/377.5

(58) Field of Classification Search ..... 53/567, 53/576, 459

See application file for complete search history.

(56) References Cited

U.S. PATENT DOCUMENTS

| | | | | | |
|---|---|---|---|---|---|
| 3,621,638 | A * | 11/1971 | Grocke | 53/559 |
| 3,638,790 | A * | 2/1972 | Schmid et al. | 206/446 |
| 3,675,765 | A * | 7/1972 | Melsek | 206/319 |
| 3,965,652 | A * | 6/1976 | Cimins | 53/567 |
| 4,070,853 | A * | 1/1978 | Sanders | 53/370.6 |
| 4,079,662 | A * | 3/1978 | Puccetti et al. | 53/552 |
| 4,365,459 | A * | 12/1982 | Grundler | 53/389.3 |
| 5,729,964 | A * | 3/1998 | Palmer | 53/377.5 |
| 6,343,459 | B1 * | 2/2002 | Seaward et al. | 53/370.6 |
| 6,938,398 | B2 * | 9/2005 | Borchard | 53/512 |
| 6,945,016 | B2 * | 9/2005 | Hannen | 53/459 |

FOREIGN PATENT DOCUMENTS

| | | | |
|---|---|---|---|
| DE | 1586456 | * | 5/1970 |
| EP | 0493641 | * | 1/1991 |
| EP | 0465370 | * | 7/1991 |

* cited by examiner

*Primary Examiner*—John Sipos
(74) *Attorney, Agent, or Firm*—Andrew Wilford

(57) ABSTRACT

An apparatus for wrapping an object having vertical sides and a top with a hood-shaped foil having a closed end and an open end fits the foil over the object in such a manner that excess-foil projections are formed at the closed end that project outward from the top of the object and an empty space is formed adjacent each projection between the foil and the object. The excess-foil projections are mechanically engaged and physically tucked between the object and the foil to push the projections into the respective empty spaces.

3 Claims, 5 Drawing Sheets

Fig.1
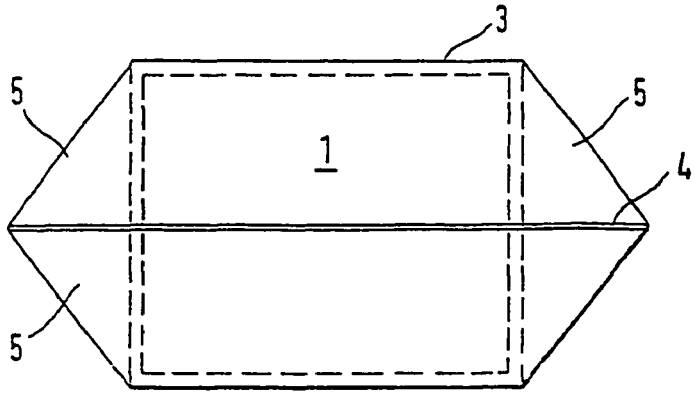
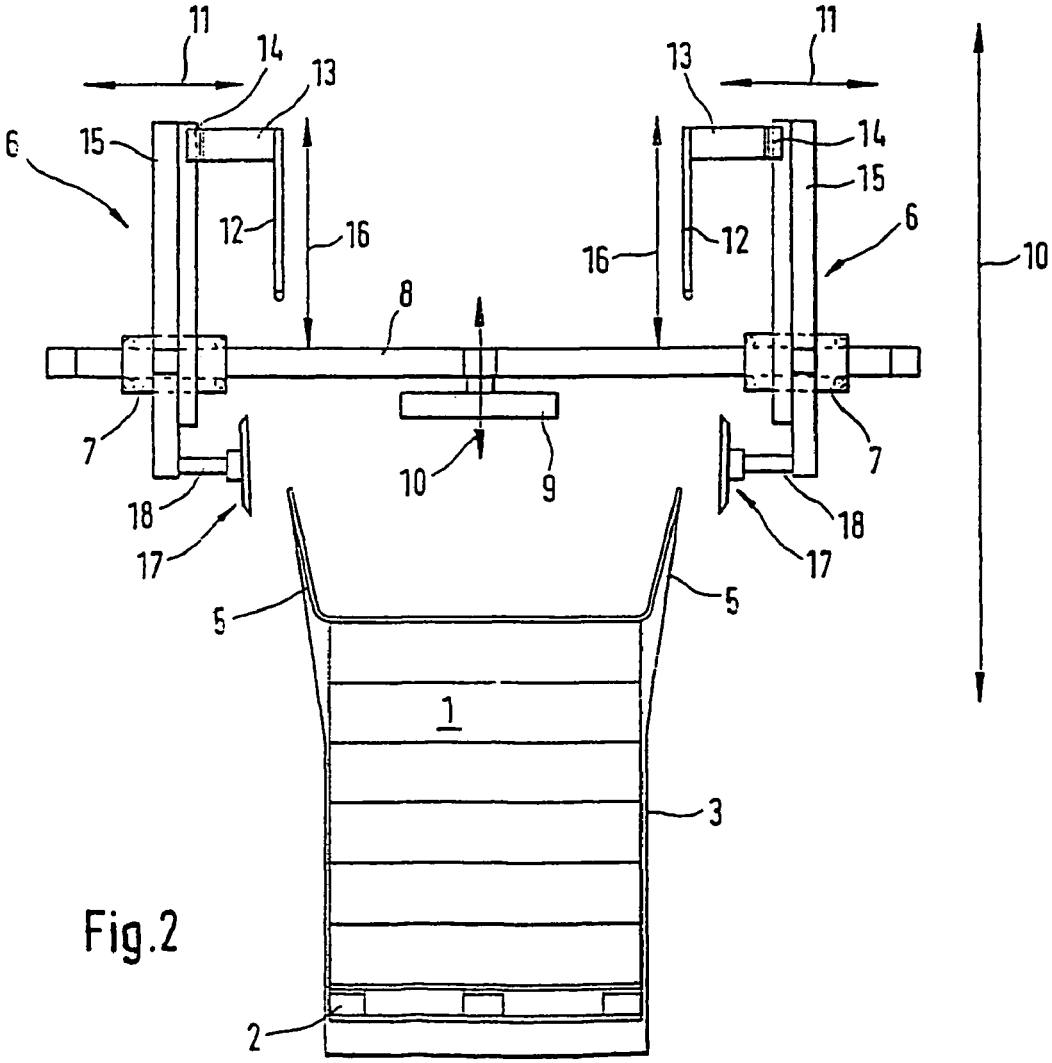
Fig.2

SHRINK- OR STRETCH-WRAPPING SYSTEM FOR OBJECT STACK

CROSS REFERENCE TO RELATED APPLICATION

This application is a continuation of application Ser. No. 10/468,424 filed 18 Aug. 2003, now U.S. Pat. No. 6,945,016, as the US national phase of PCT application PCT/EP02/01813 filed 21 Feb. 2002, published 6 Sep. 2002 as WO 02/068268, and claiming the priority of German application 201 03 153.1 filed 22 Feb. 2001.

FIELD OF THE INVENTION

The present invention relates to an apparatus and a method for tucking in excess-foil projections of a foil wrap covering the sides and at least a part of the top of a stack of objects.

BACKGROUND OF THE INVENTION

In order to wrap a stack of objects with a foil, a shrinkable or stretchable hood is made from a flattened tube. Other types of tube are possible. In the region of the top of the stack at least two end portions are welded together or even the entire end of the foil is welded closed. When installed this normally forms at the two shorter sides generally triangular excess-foil projections. These extend outward from the corners of the stack of objects past the sides of the object stack.

These excess-foil projections, also called horns or hats, have to be fixed to the sides or top of the object stack so that the wrapped object stack looks neat. The problem remains, however, that the fixed excess-foil projections, e.g. during transport of the object stack, come loose either by themselves or as a result of catching on something while being moved. If the fixation is only at several spots, this can damage the wrapping and thereby destabilize the wrapped object stack.

OBJECT OF THE INVENTION

It is therefore an object of the invention to provide a method and an apparatus by means of which the above-given disadvantages in wrapping an object stack with a foil are avoided.

SUMMARY OF THE INVENTION

This object is achieved by an apparatus for tucking in the excess-foil projections of a foil wrapped around the sides and at least partially over the top of an object stack, in particular a foil hood where the excess-foil projections are triangular and near two opposite sides of the top of the object stack at corners thereof which has means for tucking the excess-foil projections between the object stack and the foil-installing device.

Tucking the excess-foil projections into the region between the stack and the foil by means of the tucking device gives the stack on the one hand even in the region of the excess-foil projection a flat and optically appealing surface. On the other hand the excess-foil projections cannot get loose since they are covered by the foil. When the foil is a shrink hood, preferably the stack is first wrapped, and then the excess-foil projections are tucked by the tucking device in to the region between the stack and the foil. Then the foil is shrunk. It is also however possible that the tucking is done after shrinking. When a stretchable foil is used the still present excess-foil projections left after stretching are tucked by the tucking apparatus into the region between the stack and the foil.

In an embodiment of the invention in order to tuck the excess-foil projections into the region between the sides of the stack and the foil there is at least one vertically effective tucking device.

In another embodiment in order to tuck the excess-foil projections into the region between the top of the stack and the foil there is at least one horizontally effective tucking device. Such an arrangement of an apparatus according to the invention has the advantage that the wrapped object stack can be stored outside. Since the excess-foil projections are captured in the region between the top of the stack and the foil, no rain water can get in.

At least one tucking device has a pneumatically operated noncontacting tucker. In the simplest case this is a nozzle by means of which air is blown at the excess-foil projections so that they are pressed or tucked into the region between the stack and the foil.

In a preferred embodiment of an apparatus according to the invention at least one tucking device has a movable tucking element for mechanical tucking. In order to tuck in an excess-foil projection, the tucking element engages the excess-foil projection so that the excess-foil projection is shoved either into the region between one side of the stack and the foil or into the region between the top of the stack and the foil.

Preferably the tucking element has generally the same shape as the excess-foil projection. In this manner the excess-foil projection is tucked completely into the region between the foil and the stack.

To this end at least one tucking element can be connected, preferably via an arm, with a carriage, preferably with a movable slide so that the tucking element is moved in the desired direction and into the desired position.

In order to simplify tucking the excess-foil projection into the region between the stack and the foil and in order to space the foil from the stack it is wrapped around, there is a spacing device engageable with the foil in the region where the excess-foil projection is tucked in. In this manner a space is created between the foil and the stack so that the excess-foil projection is easier to tuck in.

At least one spacing device is formed as a suction gripper. The suction gripper is brought from outside into engagement with the foil. Then the suction gripper is activated to grip the foil. Moving the suction gripper out spaces the foil from the stack.

At least one spacing device can be coupled with the respective tucking device. In this manner when one of the two devices is moved the other moves synchronously.

The tucking device(s) and/or the spacing device(s) are fixed on a frame movable, preferably vertically, along the stack.

Another aspect of the invention is also a method of tucking in excess-foil projections wherein the excess-foil projections are triangular and located on opposite edges at corners on the top of the stack, and wherein the excess-foil projections projecting past the sides of the stack after wrapping of the stack are tucked into the region between the stack and the foil.

The at least one excess-foil projection extending laterally past the stack can be tucked into the region between one side of the stack and the foil.

In addition at least one excess-foil projection extending laterally past the stack is tucked into the region between the top of the stack and the foil. Such a procedure is recommended when the wrapped stack is to be stored outside, as the horizontal capturing of the excess-foil projections prevents rain water from getting in.

In carrying out the method at least one excess-foil projection extending laterally past the stack can be tucked into the region between one side of the stack and the foil by a jet of air. The air jet can be produced by a nozzle on the appropriate region of the excess-foil projection so that it is driven into the region between the stack and the foil.

It is also possible that at least one excess-foil projection extending laterally past the stack is tucked into the region between one side of the stack and the foil mechanically. This can be done for example by means of a tucking element that pushes the excess-foil projection between the foil and the stack.

In order to ease the tucking-in operation, at least the region of the foil, which after tucking-in of the excess-foil projection is in contact with the excess-foil projection, is spaced from the stack so the excess-foil projection can be tucked in. As a result of the thus produced space between the foil and the stack the excess-foil projection can be tucked in without difficulty.

To this end at least the region of the foil that after tucking-in of the excess-foil projection is in contact with the excess-foil projection is spaced by suction from the stack so the excess-foil projection can be tucked in.

BRIEF DESCRIPTION OF THE DRAWING

An embodiment of the invention is described in the following with reference to the drawing. Therein:

FIG. 1 is a schematic top view of an object stack surrounded by a foil and having on two opposite edges excess-foil projections;

FIGS. 2–7 show the individual steps for tucking the excess-foil projections between the object stack and the foil;

FIG. 8 is a schematic side view of a foil-wrapped object stack with the excess-foil projections tucked in.

SPECIFIC DESCRIPTION

Figure 3:
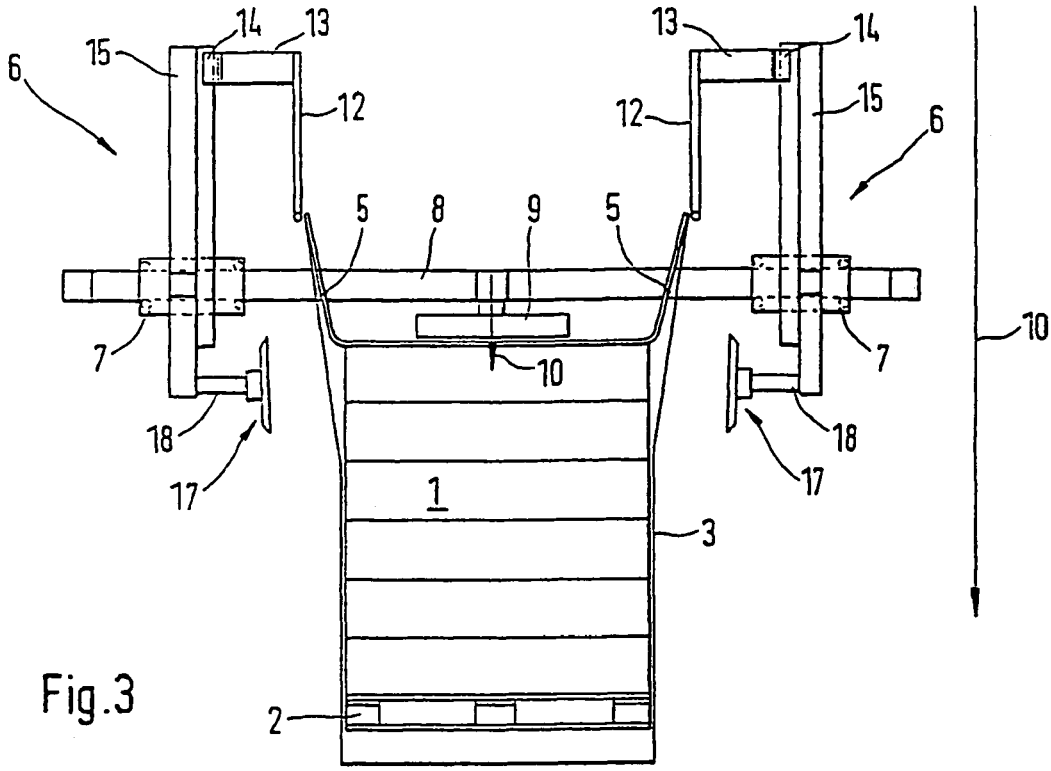

The same or similar parts are identified with the same reference numbers in all FIGS.

In the drawing an object stack 1 shown in dashed lines sits on a pallet 2. The object stack 1 is covered by a foil hood 3. The foil hood 3 can be made of a stretchable or shrinkable foil. In the embodiment illustrated in the drawing, the foil 3 has on the end that is not pulled past the object stack a continuous weld seam 4 so that the foil 3 forms a hood. As in particular shown in top view in FIG. 1, generally triangular excess-foil projections 5 are formed near the shorter sides of the object stack 1, the excess-foil projections 5 extending outward from the corners of the object stack 1.

Figure 8:
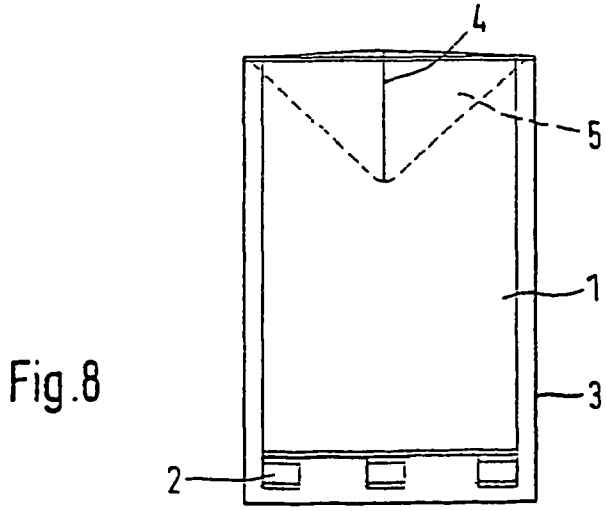

When the foil 3 is shrinkable, the stack 1 is first fitted by an unillustrated apparatus with the foil 3 so that normally, as shown in FIG. 8, the lower edge of the foil 3 reaches down past the stack to engage the pallet 2. Another unillustrated apparatus serves at a later time for shrinking the foil 3.

When the foil 3 is stretchable, it is first gathered by an unillustrated gathering device and then prestretched, In this prestretched condition the gathering device or a fitting device, if the gathered and prestretched foil is transferred to a fitting device, is normally pulled down over the stack 1 so that the gathered foil 3 is stretched out and lies on the outer sides of the stack 1. Normally in this system the stack 1 and its pallet 2 are raised by an unillustrated lift.

In order to tuck the excess-foil projections 5 between the stack 1 and the foil 3, as shown in FIGS. 2 to 7, there are tucking devices 6 on both sides of the stack 1. Each tucking device 6 is connected via a slide 7 with a frame 8 above the stack 1. The frame 8 has a central hold-down device 9 and can move vertically as shown by arrow 10. The slides 7 can move on the frame 8 so that the tucking devices 6 can move toward each other as shown by arrow 11 so as to accommodate stacks 1 of different widths.

Each tucking device 6 has a tucking element 12 that in the illustrated embodiment extends vertically. The upper end of each tucking element 12 is fixed to an arm 13 that connects the tucking element 12 with a respective slide 14. Each slide 14 in turn is movable as shown by arrow 16 on a vertical guide rail 15. Each guide rail 15 in turn is fixed on the respective slide 7.

The lower end of each guide rail 15 is provided with a suction gripper 17 forming a spacing means. The suction gripper 17 can be a suction cup. The suction devices 17 are connected via mounts 18 with the respective guide rails 15 so that each suction gripper 17 can be moved laterally on displacement of the slide 7 in the direction of arrow 11 against the stack 1.

As shown in FIG. 3 first the frame 8 is dropped as shown by the arrow 10 until the hold-down device 9 engages the top of the stack 1.

Figure 4:
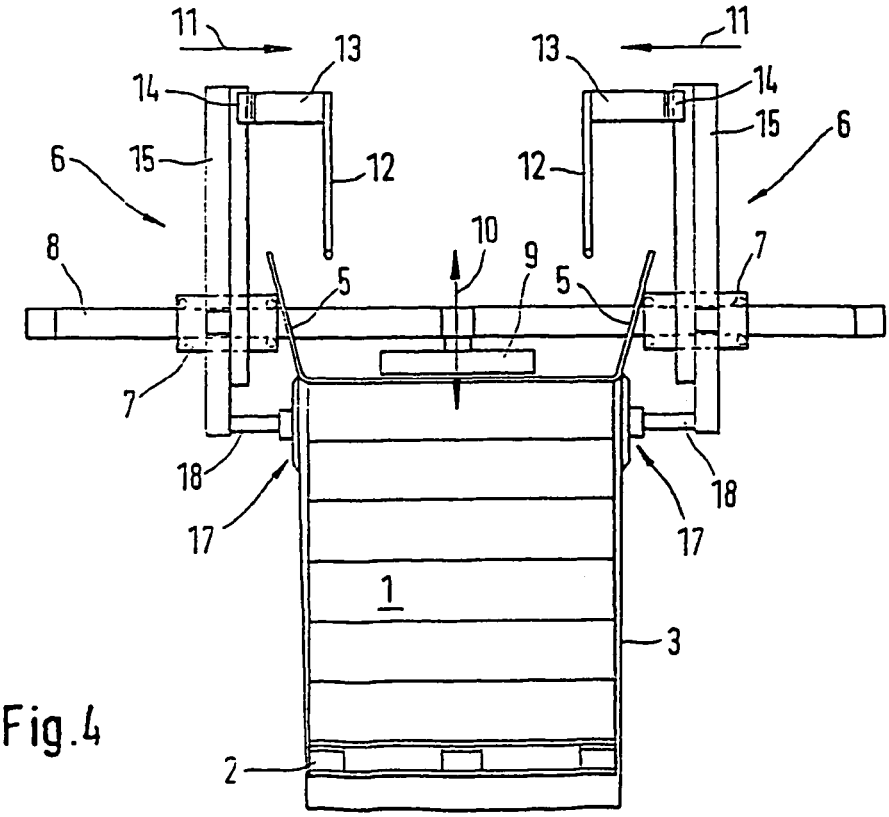

Then as shown in FIG. 4 the slides 7 are moved on the frame 8 inward as shown by arrows 11 laterally against the stack until the suction grippers 17 engages the sides of the foil 3.

Figure 5:
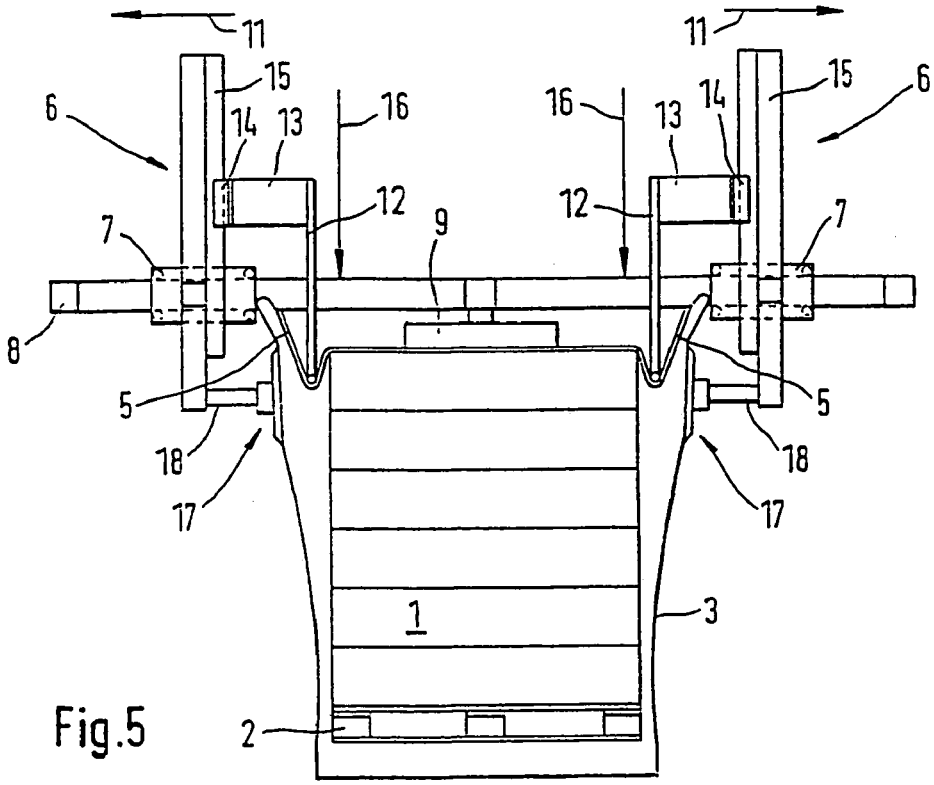

In the next step as shown in FIG. 5, the sides of the foil 3 are pulled out by the suction grippers 17 by movement of the slides 17 and their suction grippers 17 apart as shown by the arrows 11. In this manner side regions of the foil 3 are spaced outward from the sides of the stack 1. Subsequently the slides 12 are dropped as shown by arrows 16 so that the excess-foil projections 5 are tucked in between the foil 3 and the stack 1. It is preferable for the tucking elements 12 to have the same general shape as the excess-foil projections 5.

Figure 6:
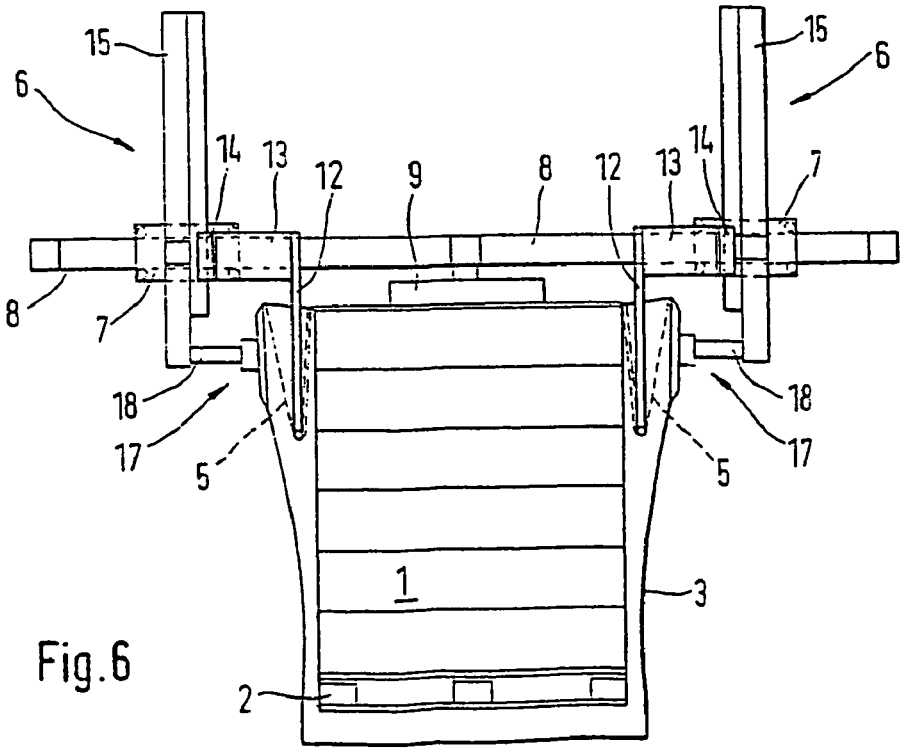

FIG. 6 shows the tucking elements 12 in their lowest positions, in which the excess-foil projections 5 are completely tucked into the region between the foil 3 and the stack 1.

Figure 7:
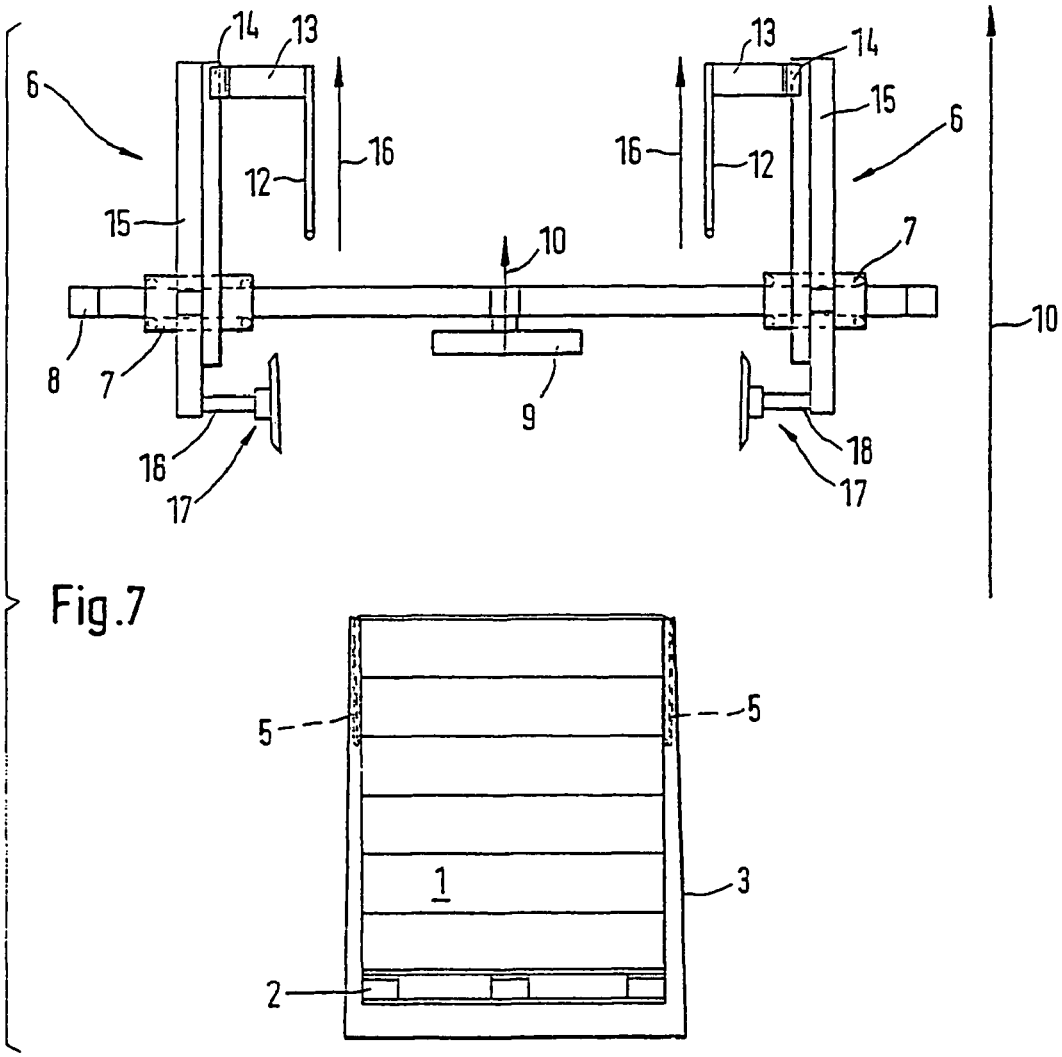

After tucking in the excess-foil projections 5, the suction grippers 17 are deactivated so that the foil 3 moves back to lie against the stack 1 as shown in FIG. 7. In addition the slides 14 are moved up on the guide rails 15 so that the tucking elements are shifted upward in the direction of the arrows 16. The same happens for the frame 8 (see arrow 10) so that the hold-down device 9 is not left in contact with the top of the stack 1.

As a result of the deactivation of the suction grippers 16, the foil 3 again comes to lie laterally on the stack 1. The excess-foil projections 5 are left as shown in FIG. 8 captured between the foil 3 and the stack 1 and are thus surely fixed in place.

Figure 9:
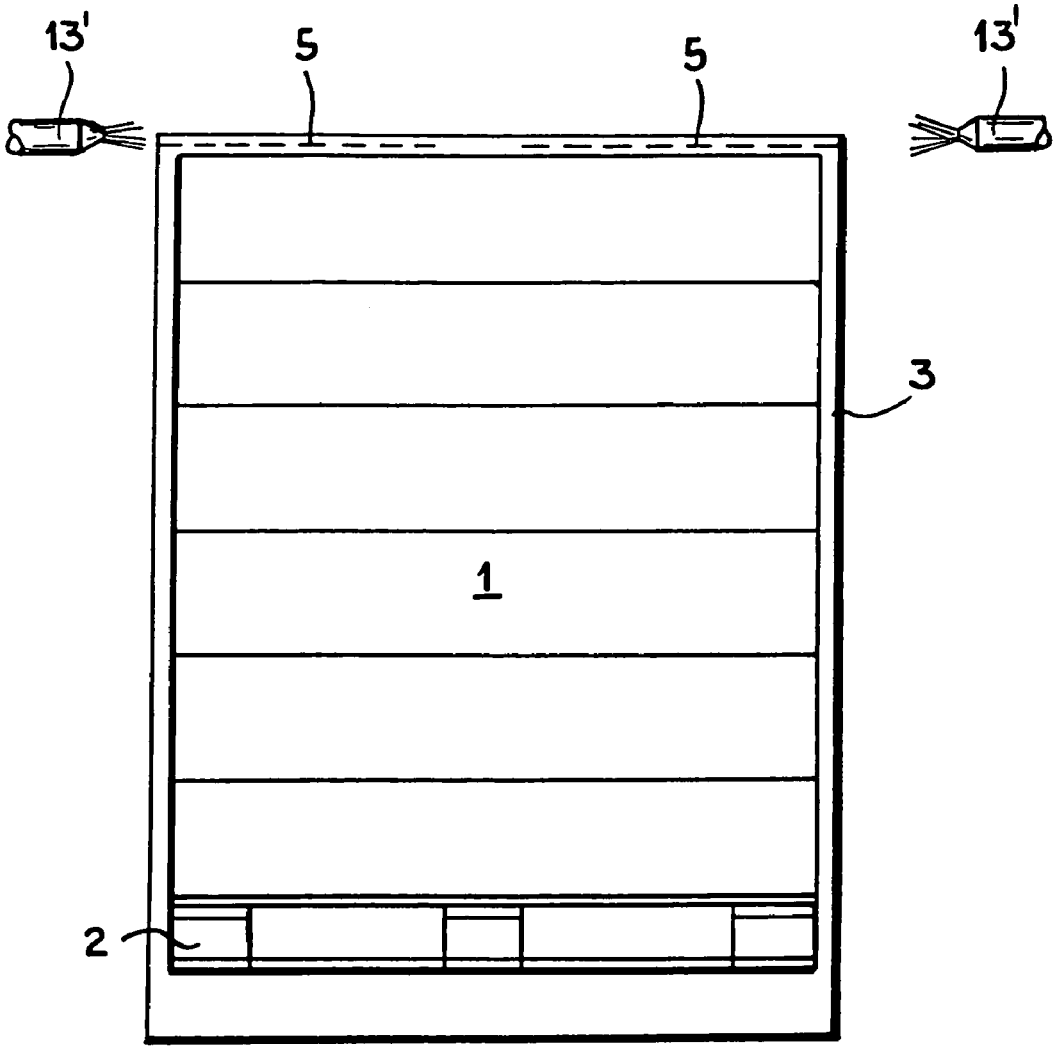
FIG. 9 is a side view of an alternative system according to the invention.

It is possible as shown in FIG. 9 to use this apparatus to tuck the excess-foil projection 5 between the top of the stack 1 and the foil 3. In this case the orientation of the tucking elements 12 and the suction grippers 17 has to be switched so that the suction grippers 17 are spaced from the foil 3 at the top of the stack 1 and the tucking elements 12 tuck the foil projections 5 between the foil 3 and the top of the stack 1. Furthermore as shown in FIG. 9, the tucking elements 13 can be replaced by nozzles 13' forming air jets.

I claim:

1. An apparatus for wrapping an object having vertical sides and a top with a hood-shaped foil having a closed end and an open end, the apparatus comprising:

means for fitting the foil over the object in such a manner that excess-foil projections are formed at the closed end that project outward from the top of the object and an empty space is formed adjacent each projection between the foil and vertical sides of the object; and means for engaging and physically tucking the excess-foil projections between the object and the foil and thereby pushing the projections into the respective empty spaces.

2. The object-wrapping apparatus defined in claim 1 wherein the fitting means includes suction grippers engageable with the foil.

3. The object-wrapping apparatus defined in claim 1 further comprising means for holding down the object during operation of the tucking means.

* * * * *